US010733966B2

(12) United States Patent
Penland

(10) Patent No.: US 10,733,966 B2
(45) Date of Patent: Aug. 4, 2020

(54) GUITAR TREMOLO

(71) Applicant: Rustin B. Penland, Nederland, TX (US)

(72) Inventor: Rustin B. Penland, Nederland, TX (US)

( * ) Notice: Subject to any disclaimer, the term of this patent is extended or adjusted under 35 U.S.C. 154(b) by 0 days.

(21) Appl. No.: 16/235,532

(22) Filed: Dec. 28, 2018

(65) Prior Publication Data

US 2019/0206373 A1 Jul. 4, 2019

Related U.S. Application Data

(60) Provisional application No. 62/611,579, filed on Dec. 29, 2017.

(51) Int. Cl.

| | |
|---|---|
| ***G10D 3/12*** | (2020.01) |
| ***G10D 3/153*** | (2020.01) |
| ***G10H 3/18*** | (2006.01) |
| ***G10D 3/04*** | (2020.01) |
| ***G10H 3/20*** | (2006.01) |
| ***G10D 1/08*** | (2006.01) |

(52) U.S. Cl.

CPC ..... *G10D 3/153* (2020.02); *G10D 1/085* (2013.01); *G10D 3/04* (2013.01); *G10D 3/12* (2013.01); *G10H 3/18* (2013.01); *G10H 3/20* (2013.01); *G10H 2210/201* (2013.01)

(58) Field of Classification Search

CPC ..... G10D 3/146; G10D 3/12; G10D 3/04; G10D 1/085; G10H 3/18

See application file for complete search history.

(56) References Cited

U.S. PATENT DOCUMENTS

| | | | | |
|---|---|---|---|---|
| 4,171,661 | A | 10/1979 | Rose | |
| 4,497,236 | A | 2/1985 | Rose | |
| 4,549,461 | A | 10/1985 | Rose | |
| 4,608,906 | A | 9/1986 | Takabayashi | |
| 4,656,915 | A | 4/1987 | Osuga | |
| 4,967,631 | A | 11/1990 | Rose | |
| 5,672,835 | A | 9/1997 | Doughty | |
| 5,717,150 | A * | 2/1998 | Rose | G10D 3/12 84/297 R |
| 5,847,297 | A | 12/1998 | Fisher, IV | |
| 6,700,043 | B2 | 3/2004 | Hirayama | |
| 6,867,354 | B2 | 3/2005 | Shimooka et al. | |

* cited by examiner

*Primary Examiner* — Kimberly R Lockett

(74) *Attorney, Agent, or Firm* — Winston & Strawn LLP

(57) ABSTRACT

A tremolo and tuning apparatus for a stringed musical instrument. The stringed musical instrument includes a body and a neck, a plurality of strings extending from the body to the neck, a nut for supporting the strings on the neck forming a first critical point for each string, a bridge element for supporting the strings on the body forming a second critical point for each string. The apparatus includes a tremolo and tuning apparatus having a one-piece saddle configured to hold unmodified strings which include the ball end uncut. The tremolo and tuning apparatus also includes a plurality of tuner rods disposed atop each string and separate from the saddle. These tuner rods are configured to fine tune each string by a user pressing downward on each tuner rod as needed to tune each string of the stringed musical instrument rather than pulling and releasing tension in each string.

16 Claims, 17 Drawing Sheets

GUITAR TREMOLO

This application claims the benefit of provisional application No. 62/611,579 filed Dec. 29, 2017, the entire content of which is expressly incorporated herein by reference thereto.

FIELD OF THE INVENTION

The present invention relates generally to stringed musical instruments. More particularly, the present invention relates to a tremolo and tuning apparatus for an electric guitar including a method and a means for associating the tremolo and tuning apparatus with a guitar and with guitar strings in such a manner that the tremolo and tuning apparatus changes the pitch of strings without being off-key and without using a pull and release mechanism to remain in tune.

BACKGROUND OF THE INVENTION

As is known to those skilled in the art of stringed musical instruments, such as guitars, the strings of the musical instrument extend between two critical contact points, typically provided on or at the nut of the musical instrument and on or at the bridge of the musical instrument. Each of the strings also extends beyond at least one of the critical contact points where it is secured to a tuning peg or tuning machine provided on the musical instrument for adjusting the tension of the string. The other end of the string also generally extends beyond the other control contact point so as to be anchored to the musical instrument.

As is also known in the art, the sound produced by each of the strings is affected both by the string length between the critical contact points and by the tension on the string. Generally, the string length is adjusted by adjustment of the distance between the critical contact points at which the string contacts the bridge and nut elements of the musical instrument. This is generally referred to as harmonic or string length tuning. The tension of the strings of the musical instrument is generally adjusted by means of the tuning pegs or machines which serve to increase or decrease the tension of the strings. This latter type of adjustment is often referred to as pitch or fine tuning of the strings. Generally, each of the strings of a musical instrument may be both pitch and harmonically tuned individually and independently of the other strings of the musical instrument.

Tremolo and tuning apparatuses for stringed musical instruments are also generally well-known and are typically used to simultaneously and significantly either reduce or increase the tension of all of the strings of the musical instruments to thereby produce unusual tone variations or special sound effects. Although the effects achievable with tremolo and tuning apparatuses on guitars and the like were popularized in the 1960's, many musicians did not readily adopt and/or continue the use of tremolo and tuning apparatuses due to problems of detuning of the strings of the guitars on which the tremolo and tuning apparatuses were mounted and used. As a result of several inventions made by Floyd Rose, an inventor, in late 1970's and early 1980's, several of the problems associated with detuning of the strings of guitars employing tremolo and tuning apparatuses were minimized.

More particularly, in accordance with one of the inventions of Floyd Rose, which is the subject of Rose's U.S. Pat. No. 4,171,661 issued Oct. 23, 1979, the bridge of the musical instrument is provided on the tremolo and tuning apparatus and the strings are held or "locked" at or in the vicinity of both the bridge and the nut of the instrument so as to be restrained against relative sliding movement during activation and return of the tremolo and tuning apparatus. In this manner, after the tremolo is used and then returned to an inactive position, the strings essentially return to the same tension as before activation and, therefore, remain in tune. In the preferred embodiment disclosed in the '661 patent, the strings of the instrument are clamped at both the nut of the guitar and at the bridge of the guitar, with the clamping bridge elements being mounted on and movable with the tremolo and tuning apparatus. This invention of Floyd Rose is sometimes referred to as his "string locking" invention. In the Floyd Rose invention, the ball end of the strings disposed at the tremolo and tuning apparatus must be cut-off at the ball when stringing the guitar.

Two further significant improvements of Floyd Rose in tremolo and tuning apparatuses are embodied in U.S. Pat. No. 4,497,236 (and its continuation, U.S. Pat. No. 4,549,461). One of the improvements resides in the provision of fine tuning means mounted on and movable with the tremolo and tuning apparatus for fine tuning of the strings essentially without changing the harmonic tuning thereof. The second improvement resides in a particular type of fine tuning means in which the string support means (which includes the bridge of the instrument) and the string holding means (which hold the strings) are moved substantially as a unit to effect fine tuning of the strings individually without changing the harmonic tuning thereof. This latter improvement thus permits fine tuning of the strings as well as employment of the first Floyd Rose invention which is the subject of the '661 patent in that movement of the strings relative to the bridge of the instrument is minimized.

In the particular embodiment disclosed in the '236 patent, which employs both of the aforenoted improvements, individual bridge elements are provided for each of the strings of the instrument. Each of the bridge elements is of a two-piece construction and includes a first forward block element and a second rear block element which is rotatably mounted to the first block and which includes a string contact surface thereon. Each forward block element is mounted for sliding movement on the base plate of the tremolo and tuning apparatus for adjusting or changing the harmonic tuning of its respective string. Each rear, rotatable block element includes a clamping block for clamping the string against the string contact surface. The clamping block is urged against the string by means of a threaded shank or rod which extends rearwardly of the rear block element through a suitable slot provided in an upwardly extending flange of the tremolo and tuning apparatus. Fine tuning adjustment screws are mounted to the flange of the tremolo and tuning apparatus and are positioned so as to contact the extended portion of the threaded shank or rod to thereby adjust the rotatable position of the rear block. This, in turn, adjusts the tension of the string held thereby, essentially without changing the harmonic tuning of the strings, since the distance between the critical contact point on the nut and the critical contact point on the bridge (provided on the forward portion of the string contact surface of the rear block element) essentially remains the same.

The tremolo and tuning apparatus in accordance with the Floyd Rose inventions have enjoyed huge commercial success, the inventions of such patents having been licensed throughout the electric guitar industry. As a result, numerous variations of tremolo and tuning apparatus employing the inventions of the Floyd Rose '661 and '236 patents have been developed in an effort to provide an optimum tremolo and tuning apparatus. Among several of the improvements and/or variations have been tremolo and tuning apparatus in which attempts have been made to decrease the profile of the tremolo apparatus by decreasing the height or elevation of the flange on which the fine tuning adjustment members are mounted. Thus, tremolo bridge systems have heretofore been developed having angled, rearwardly-directed flanges which extend obliquely relative to the surface of the tremolo base plate and which have a downwardly extending portion on which the fine tuning adjustment members are mounted so that the adjustment members move in a direction generally oblique to the surface of the tremolo base plate, as opposed to perpendicularly thereto as shown in the embodiment of the '236 patent. In another variation of a tremolo bridge system, a camming-type mechanism is utilized in which the rearwardly-extending shanks of the rotatable block elements are provided with a rotatable sleeve that engages against a sloped surface of the rear flange of the tremolo and tuning apparatus. By rotation of the sleeve, the rotational position of the rotatable block element is adjusted to adjust the tension of the string held thereby. In each of these variations of prior tremolo bridge systems, however, the rearwardly-extending members connected to the rotatable bridge elements are arranged or positioned at an elevation above the surface of the tremolo base plate and thus, there is still provided a relatively high profile, as well as a relatively complicated, awkward adjustment procedure.

Here it should be noted that these Floyd Rose tremolo and tuning apparatuses include a two-piece design saddle having a metal rod which screws into the saddle to be used for fine tuning. Also, the Floyd design relies on the pulling or releasing of the tension through the saddle when fine tuning the strings which may result in detuning problems. Accordingly, the search has continued for further improvements in an effort to optimize tremolo and tuning apparatus for stringed musical instruments.

SUMMARY OF THE INVENTION

The foregoing needs are met, to a great extent, by the present invention, which provides a tremolo and tuning apparatus for a stringed musical instrument. The apparatus comprises a base tuner plate attached to the stringed musical instrument; a plurality of saddles adjustably attached to the base tuner plate and configured to hold unmodified strings; a plurality of tuner rods corresponding to and aligned with strings disposed on the stringed musical instrument; a tuner rod plate integral with the base tuner plate and configured to provide a plurality of tuner rod seats; a tuner screw hold down plate disposed above the plurality of tuner rods; and a plurality of fine tuning adjustment screws disposed proximal the plurality of tuner rods. Each of the plurality of tuner rods is configured to provide pressing contact via a user to each of their corresponding strings to fine tune each corresponding string. Also, each of the plurality of fine tuning adjustment screws is configured to provide a stop abutment at a top surface of each of the corresponding plurality of tuner rods.

The tuner rod plate advantageously comprises a plurality of string nut bores configured to securely hold a string nut of a string of the stringed musical instrument. Also, a plurality of string bores are disposed within the plurality of string nut bores, where each of the plurality of string bores is configured to receive each string.

The plurality of tuner rods are preferably disposed separate and apart from the plurality of saddles. Each of the plurality of saddles is configured as a one-piece saddle. The plurality of tuner rods are configured to pivot about a common axis.

The tuner plate comprises a tremolo bar holder which is preferably configured to provide a press fit to a tremolo bar disposed therein. The base tuner plate is attached to the stringed musical instrument by an arrangement of plate screws located at the distal end of the turner plate, with the tuner plate screws advantageously disposed within U-shaped openings at the distal end of the tuner plate.

The common axis comprises a tuner rod plate pin configured to extend the length of the tuner rod plate. In particular, the tuner rod plate is configured to receive the plurality of tuner rods within a plurality of tuner rod seats disposed on an upper portion of the tuner rod plate.

In one embodiment, the saddles are removably attached to the base tuner plate so that they can be selectively positioned.

In another embodiment, the saddles are operatively associated with the base tuner plate by rotatable pins such that rotation of the pins adjusts the position of the saddles on the base tuner plate.

Typically, six bridge saddles are present to support six guitar strings, wherein each saddle has two rollers and a channel for supporting one guitar string, wherein the first and sixth saddle have the same height, the second and fifth saddle have the same height which is greater than that of the first and sixth saddles and the third and fourth saddles have the same height which is greater than that of the second and fifth saddles.

The invention also provides a method of stringing and fine tuning a stringed musical instrument, which comprises providing a tremolo and tuning apparatus such as are described herein to the stringed musical instrument; inserting a plurality of strings into the tremolo and tuning apparatus while maintaining a ball end of each of the plurality of strings attached thereto; attaching the free end of the plurality of strings to a matching plurality of tuning posts; and tensioning the plurality of strings at the matching plurality of tuning posts to tune the stringed musical instrument. The tremolo and tuning apparatus of the stringed musical instrument can then be played to determine whether each of the plurality of strings of the stringed musical instrument is still in tune.

The method further comprises, when determining that the stringed musical instrument is not in tune, then fine tuning the stringed musical instrument by applying pressure to at least one of a plurality of tuner rods disposed within the tremolo and tuning apparatus to cause a lower surface of the at least one of the plurality of tuner rods to stretch the determined out of tune strings of the plurality of strings to return in tune.

There has thus been outlined certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

Various features of examples and embodiments accordance with the principles described herein may be more readily understood with reference to the following detailed description taken in conjunction with the accompanying drawings, where like reference numerals designate like structural elements, and in which.

Figure 1:
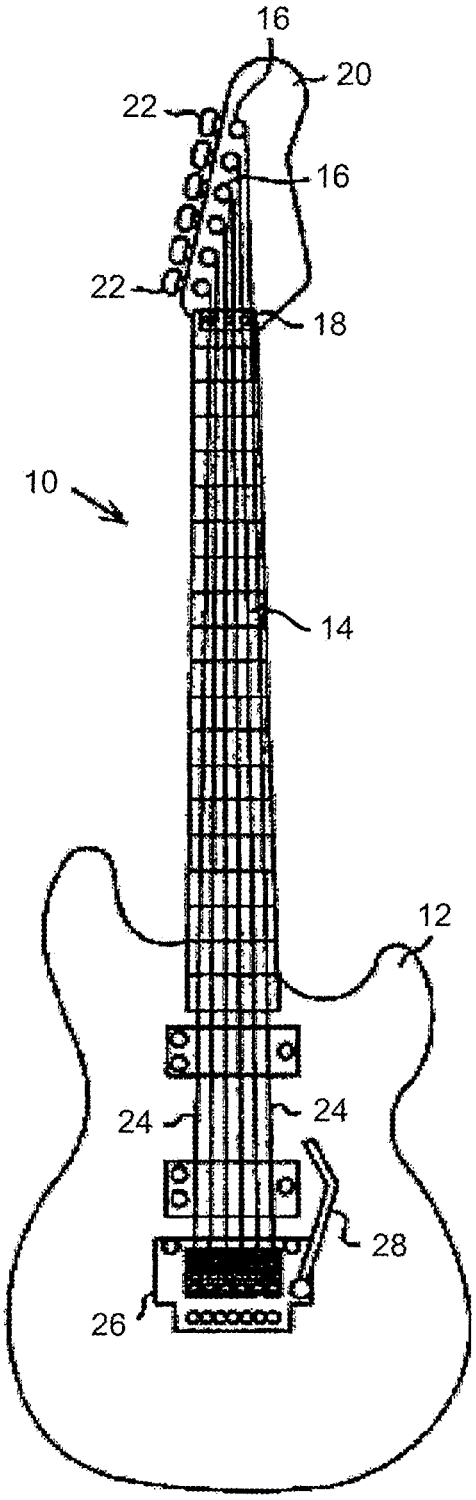
FIG. 1 is a front view illustrating an electric guitar including an exemplary tremolo and tuning apparatus according to certain embodiments of the disclosure.

Certain examples and embodiments have other features that are one of in addition to and in lieu of the features illustrated in the above-referenced figures. These and other features are detailed below with reference to the above-referenced figures.

DETAILED DESCRIPTION

In this respect there has thus been outlined the more important features of the instant invention, in order that the detailed description thereof that follows may be better understood, and in order that the present contribution to the art may be better appreciated.

There are additional features of the instant invention, which will be described hereinafter, and which will form the subject matter of the claims appended hereto.

Further in relation to this, before explaining at least the preferred embodiments of the invention in greater detail, it is to be understood that the invention is not limited in its application to the details of construction and to the arrangements of the components set forth in the following description, or illustrated in the appended Figures. The invention is capable of other embodiments, and of being practiced and carried out in a plurality of different ways. Also it is to be understood that the terminology used herein is for the purpose of description and should not be regarded as a limiting factor.

As a preliminary matter, it will readily be understood by one having ordinary skill in the relevant art that the present invention has broad utility and application. Other embodiments may be discussed for additional illustrative purposes in providing a full and enabling disclosure of the present invention. Moreover, many embodiments such as adaptations, variations, modifications, and equivalent arrangements will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed to limit the scope of patent protection afforded by the present invention, which scope is to be defined by the claims and the equivalents thereof. It is not intended that the scope of patent protection afforded the present invention be defined by reading into any claim a limitation found herein that does not explicitly appear in the claim itself.

Thus for example any sequence(s) and/or temporal order of steps of various processes or methods that are described herein are illustrative and should not be interpreted as being restrictive. Accordingly, it should be understood that although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders, while still falling within the scope of the present invention. Accordingly, it is intended that the scope of patent protection afforded the present invention is to be defined by the appended claims rather than the description set forth herein.

Additionally, it is important to note that each term used herein refers to that which the ordinary artisan would understand such term to mean based on the contextual use of such term herein. To the extent that the meaning of a term used herein as understood by the ordinary artisan based on the contextual use of such term differs in any way from any particular dictionary definition of such term, it is intended that the meaning of the term as understood by the ordinary artisan will prevail.

The following definitions generally set forth the parameters of the present invention.

As used herein, "a" and "an" each generally denotes "at least one" but does not exclude a plurality unless the contextual use clearly dictates otherwise.

As used herein, the singular form "a", "and", and "the" include plural referents unless the context clearly dictates otherwise.

Now generally referring to the drawings in which like numerals represent like components throughout the several views, the preferred embodiments of the present invention are next described. The following description of one or more preferred embodiment(s) is merely exemplary in nature and is in no way intended to limit the invention, its application, or uses.

An embodiment in accordance with the present invention provides a tremolo and tuning apparatus for a stringed musical instrument, such as an electric guitar, the stringed musical instrument including a body and a neck, a plurality of strings extending from the body to the neck, a nut for supporting the strings on the neck forming a first critical point for each string, a bridge element for supporting the strings on the body forming a second critical point for each string. The apparatus includes a tremolo and tuning apparatus having a one-piece saddle configured to hold unmodified strings, such as a guitar string which includes the ball end uncut. The tremolo and tuning apparatus also includes a plurality of tuner rods disposed atop each string and separate from the saddle. These tuner rods are configured to fine tune each string by a user pressing downward on each tuner rod as needed to tune each string of the stringed musical instrument rather than pulling and releasing tension in each string. The result of the tuner rod configuration is an easier, faster and more effective manner of fine tuning a stringed musical instrument having a tremolo.

An electric guitar 10 that is provided with a tremolo and tuning apparatus 26 according to a preferred embodiment of the present invention will now be described with reference to FIGS. 1 to 10.

FIG. 1 is a front view illustrating an electric guitar 10 including an exemplary tremolo and tuning apparatus 26 according to certain embodiments of the disclosure. In FIG. 1, the entire electric guitar 10 is illustrated from the top surface side. The near side of FIG. 1 along the direction perpendicular to the surface of the sheet of FIG. 1 is referred to as the upper direction of the electric guitar 10 and the upper side of FIG. 1 is referred to as the front side of the electric guitar 10.

The electric guitar 10 includes a solid body 12 and a neck 14, which extends from the body 12. A head 20 is located at the distal end of the neck 14. Six tuning posts 16 are arranged on the head 20 and can be rotated to wind up strings 24. A gear mechanism (not shown) is arranged on the backside of each tuning post 16. Tuning pegs 22, each of which is provided for one of the tuning posts 16, are located on the head 20. Each tuning peg 22 rotates the corresponding tuning post 16 by the gear mechanism. That is, each set of the tuning post 16, the gear mechanism, and the tuning peg 22 tunes the corresponding string 24. A nut 18 is located at the distal end of the neck 14 and the strings 24 contact the nut 18. The strings 24 are pressed by a pressing member from above and tightened to the nut 18 with bolts.

FIGS. 2 to 10 illustrate a first embodiment of the invention. The tremolo and tuning apparatus 26 is located at the center of the body 12 shifted slightly rearward. The six strings 24, which are pressed against the nut 18, are pressed against the tremolo and tuning apparatus 26. The strings 24 are tightly stretched at a predetermined tension and substantially parallel to one another. The body 12 has a pick-up, which detects vibration of the strings and converts the vibration into electric signals. The electric signals generated by the pick-up are transmitted to an amplifier via a cable (not shown) to be amplified and subsequently converted into sound.

The structure of the tremolo and tuning apparatus 26 will now be described with reference to perspective views illustrated in FIG. 2. The tremolo and tuning apparatus 26 includes a base tuner plate 32 and a plurality of bridge saddles 30. The base tuner plate 32 is arranged on the body 12 by tuner plate screws 34. The bridge saddles 30 are arranged on the upper surface of the base tuner plate 32 and supports the strings 24. The bridge saddles 30 are also configured as a one-piece saddle. The tremolo and tuning apparatus 26 includes a plurality of tension applying mechanisms or tuner rods 36 and a tremolo manipulation mechanism or tremolo bar 28, also known as a 'whammy bar.' The tension applying mechanism 25 urges the base tuner plate 32 such that the base tuner plate 32 is flexed or rotated in a direction to apply tension to the strings 24. The tremolo bar 28 is located on the base tuner plate 32 and flexes or rotates the base tuner plate 32 about the tuner plate screws 34.

The tuner plate screws 34, the tension applying mechanisms or tuner rods 36, and the tremolo manipulation mechanism or tremolo bar 28 will now be described.

Figure 2:
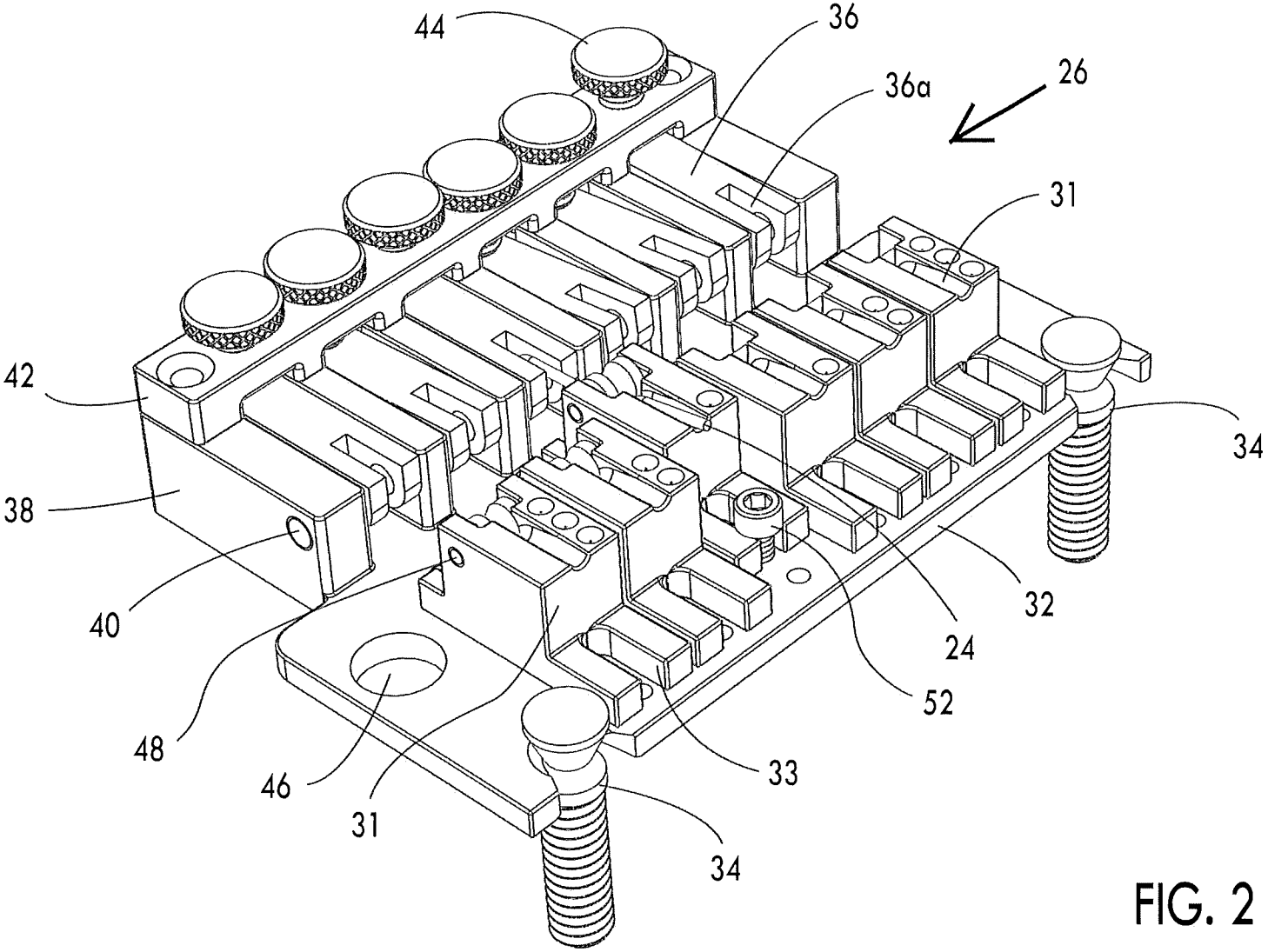
FIG. 2 is a front perspective view illustrating a first embodiment of an exemplary tremolo and tuning apparatus of a type suitable for carrying out the functions of the invention.
Figure 3A:
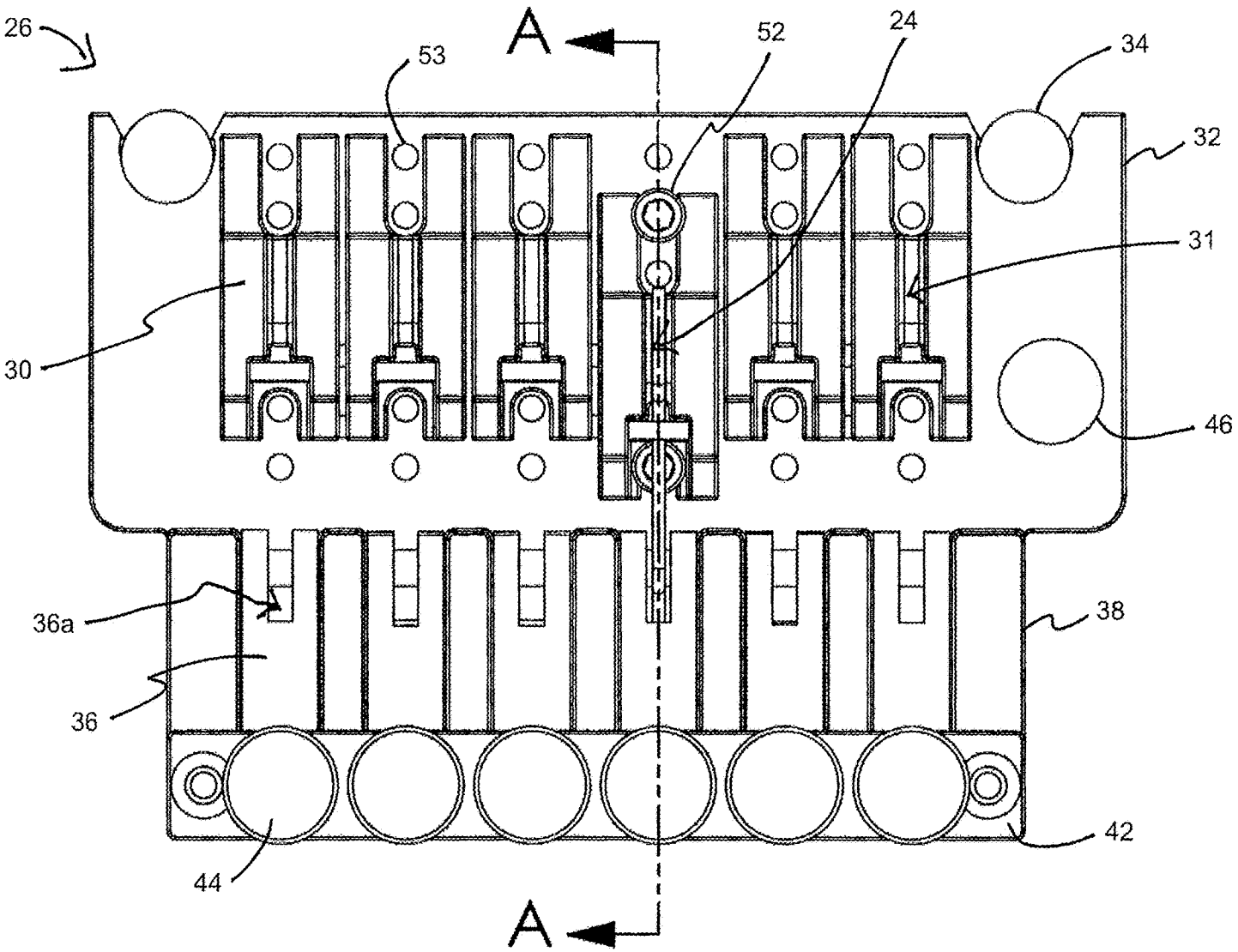
FIG. 3A is a top plan view illustrating the tremolo and tuning apparatus according to certain embodiments of the disclosure.
Figure 3B:
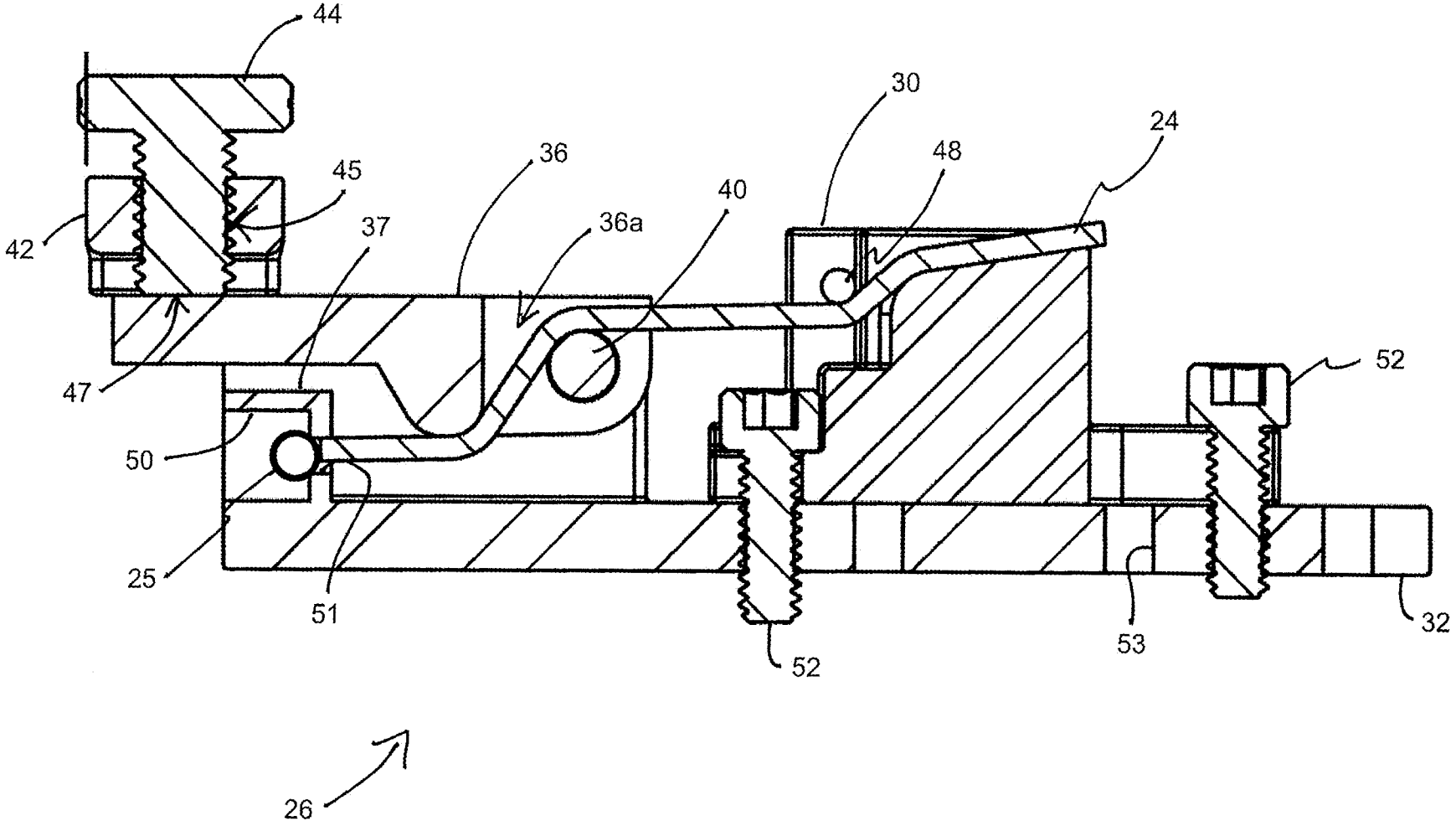
FIG. 3B is a cross-sectional view taken along the A-A in FIG. 3A.

Each tuner plate screw 34 includes a head and a threaded portion as illustrated in FIG. 2. The base tuner plate 32 is secured to the body 12 by tuner plate screws 34. The tremolo bar 28 is coupled to the base tuner plate 32 when inserted into bore opening 46 by a friction fit, press fit or the like. When activated or used the tremolo bar 28 is configured to cause a vibrato sound to the strings 24 by tensioning and then releasing the strings 24. The base tuner plate 32 is a two-piece configuration including a tuner rod plate 38 and a tuner screw hold down plate 42 disposed and connected adjacent to and above the tuner rod plate 38. A plurality of saddles 30 are mounted to base tuner plate 32 by head cap screws 51 as shown in FIG. 2 into screw bores 53 as shown in FIGS. 3A and 3B. A plurality of screw bores 53 are formed integrally with the base tuner plate 32 as especially shown in FIG. 7A.

The number of the bridge saddles 30 corresponds to the number of the strings 24. Since the bridge saddles 30 are identical, the structure of one of the bridge saddles 30 will be described with reference to FIGS. 2 to 6. Each bridge saddle 30 includes a string holder groove 31. The bridge saddle 30 has a front slot 33 at its distal end. Threaded holes 53 are formed in the base tuner plate 32. A head cap screw 52 is inserted downward in the front slot 33. The bolt 52 is then threaded into the corresponding threaded hole 53 so that the bridge saddle 30 is secured at a predetermined position on the base tuner plate 32. The string holder groove 31, which is formed at the front end of the bridge saddle 30, contacts the string 24 at a contact point.

Figure 7A:
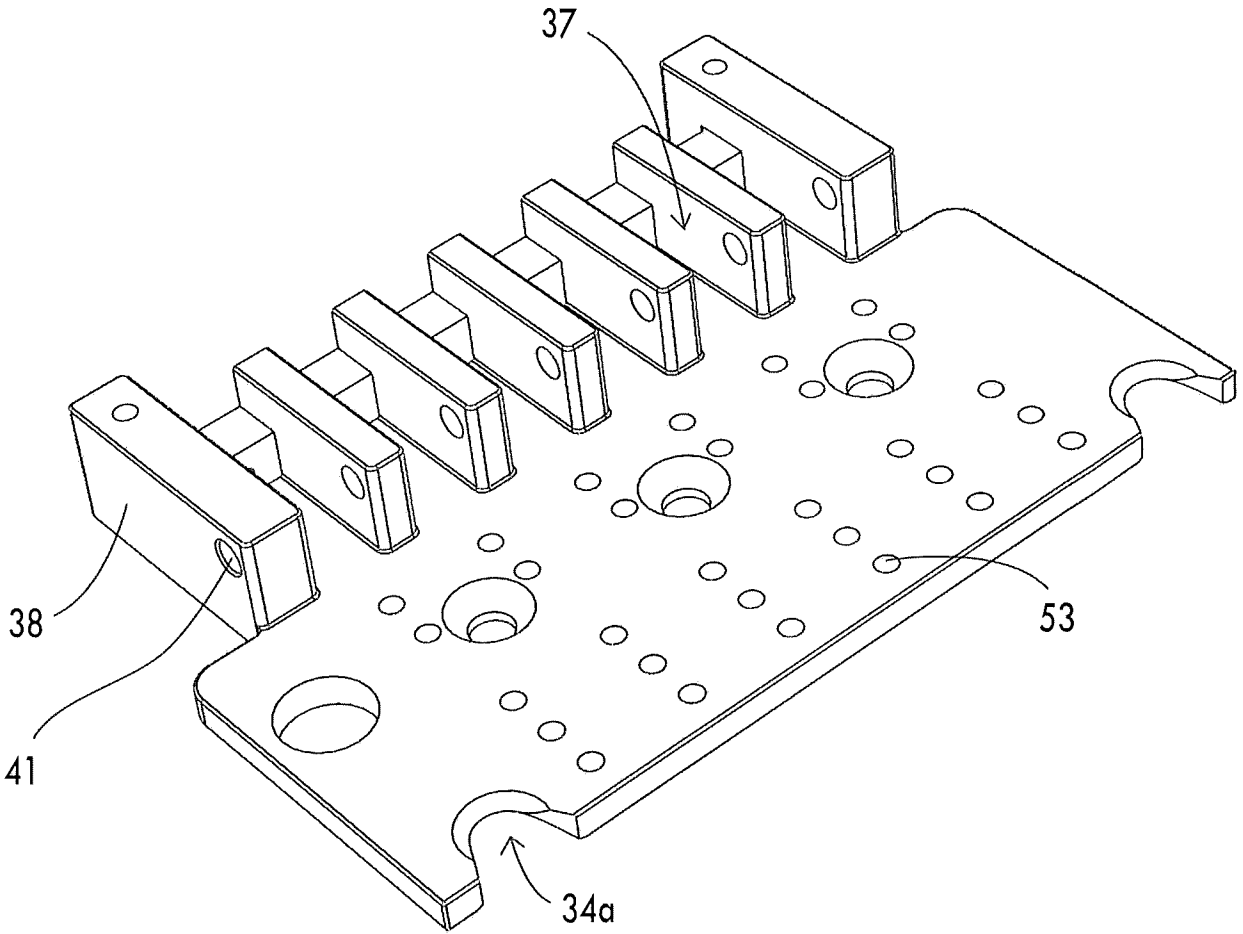
FIG. 7A is a perspective view illustrating a base tuner plate and a tuner rod plate of the tremolo and tuning apparatus according to certain embodiments of the disclosure.
Figure 7B:
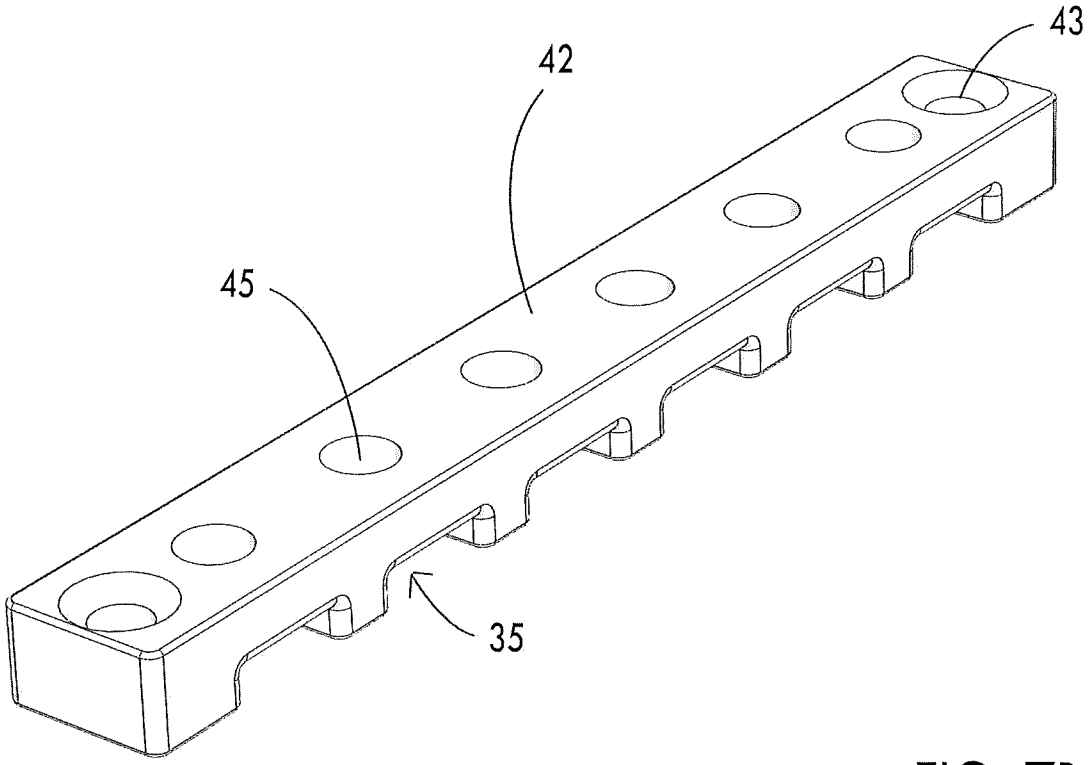
FIG. 7B is a perspective view illustrating a tuner screw hold down plate of the tremolo and tuning apparatus according to certain embodiments of the disclosure.

A saddle pin 48 retains the corresponding string 24 in cooperation with a receiving surface of the string holder groove 31 of the bridge saddle 30 as shown in FIG. 3B. A through hole 51 through which the string 24 is inserted is formed in the tuner rod plate 38. The end of the corresponding string 24, including the end ring nut 25, is held within a string nut bore 50 at a receiving surface of the string nut bore 50, as shown in FIG. 3B. The tuner rods 36 is mounted in the tuner rod plate 38 between tuner rod recesses 35 and tuner rod seats 37, as shown in FIGS. 7A and 7B.

In certain embodiments, tuner rods 36 are configured to stretch strings 24 to fine tune the stringed musical instrument 10, as shown in FIG. 3B. In other words, in operation, a user may wish to fine tune the 'G' string after using the tremolo and tuning apparatus 26 by pressing on tuner rod 36 causing the 'G' string to stretch until tuned and then the user may tighten the fine tuning adjustment screw 44 which corresponds to the 'G' string position to hold and maintain the pressed position of the corresponding tuner rod 36 which was pressed for tuning.

A threaded bore 45 is formed at the rear end of the tremolo and tuning apparatus 26 apart from the bridge saddle 30 and through the tuner screw hold down plate 42, as shown in FIG. 3B. A threaded portion of a fine-tuning adjustment screw 44 is inserted downward through the threaded bore 45 of the tuner screw hold down plate 42. A distal end 47 of the fine-tuning adjustment screw 44 is engaged with the top surface of tuner rod 36 to cause tuner rod 36 to abut and press against string 24 to initiate fine tuning thereof. The tuner screw hold down plate 42 is configured to be attached by to tuner rod plate 38 by a threaded screw, bolt or the like. Guide through holes 53 are formed in the base tuner plate 32 to hold the saddles 30 in alignment with each string 24.

FIG. 3A is a top plan view illustrating the tremolo and tuning apparatus 26 according to certain embodiments of the disclosure. In FIG. 3A, bridge saddle 30 at the 'G' string position is adjusted with string 24 disposed within string groove 31 of bridge saddle 30 and guided beneath saddle pin 48. Bridge saddle 30 is held in position by head cap screws 52 threadedly disposed in threaded guide holes 53 to secure bridge saddle 30 into position as desired by a user. FIG. 3A also illustrates elements of the tremolo and tuning apparatus 26 as discussed above.

FIG. 3B is a cross-sectional view taken along the A-A in FIG. 3A. FIG. 3B illustrates how the string 24 is threaded through string orifice 51 with its string ball end 25 still attached. String 24 is disposed along a surface of bridge saddle 30 and guided beneath a bottom surface of tuner rod 36 and beneath saddle pin 48 along a top surface of bridge saddle 30 correspondent to the string groove 31 and towards the neck 14 of stringed musical instrument 10. FIG. 3B also illustrates the features of head cap screws 52 disposed in threaded guide holes 53 in base tuner plate 32 to secure bridge saddle 30 on base tuner plate 32. FIG. 3B further illustrates string nut bore 50 disposed in tuner rod plate 38 and with bore 50 configured to accommodate and hold string ball end 25. FIG. 3B also illustrates the physical relationships between the pivotal tuner rod 36 about tuner rod plate pin 40 for movement within tuner rod seat 37 of the tuner rod plate 38 and tuner rod spacer 35 of the tuner screw hold down plate 42. FIG. 3B further illustrates the fine tuning adjustment screw 44 including a distal end 47 with screw 44 threadedly disposed in a threaded screw bore 45 to engage or disengage each tuner rod 36 as needed to fine tune each string 24.

Figure 4A:
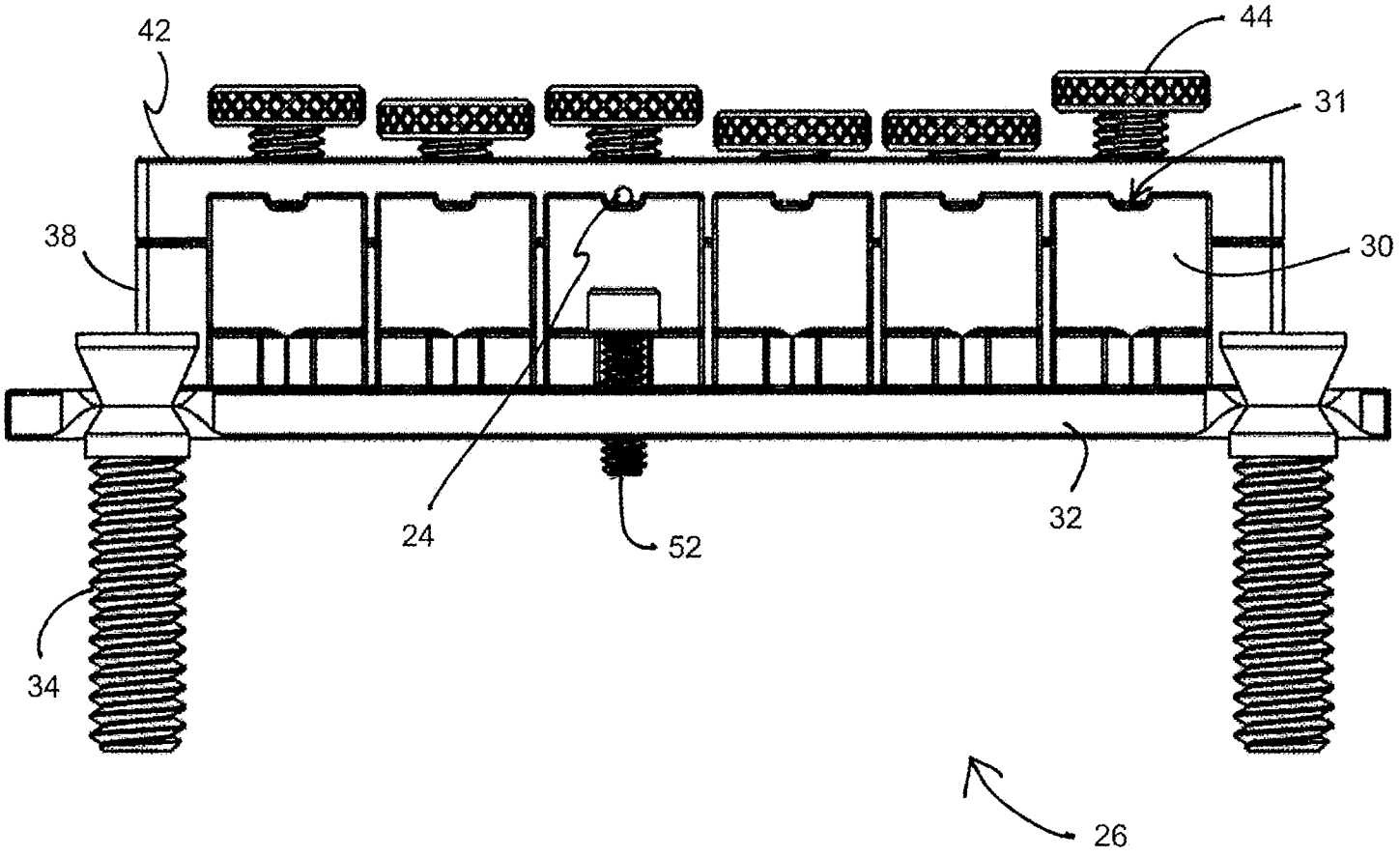
FIG. 4A is a front plan view illustrating the tremolo and tuning apparatus according to certain embodiments of the disclosure.

FIG. 4A is a front plan view illustrating the tremolo and tuning apparatus 26 according to certain embodiments of the disclosure. In FIG. 4A, the 'G' string is shown disposed within the string groove 31 of bridge saddle 30 as an example with head cap screws 52 locating and securing the bridge saddle 30 to the base tuner plate 32.

Figure 4B:
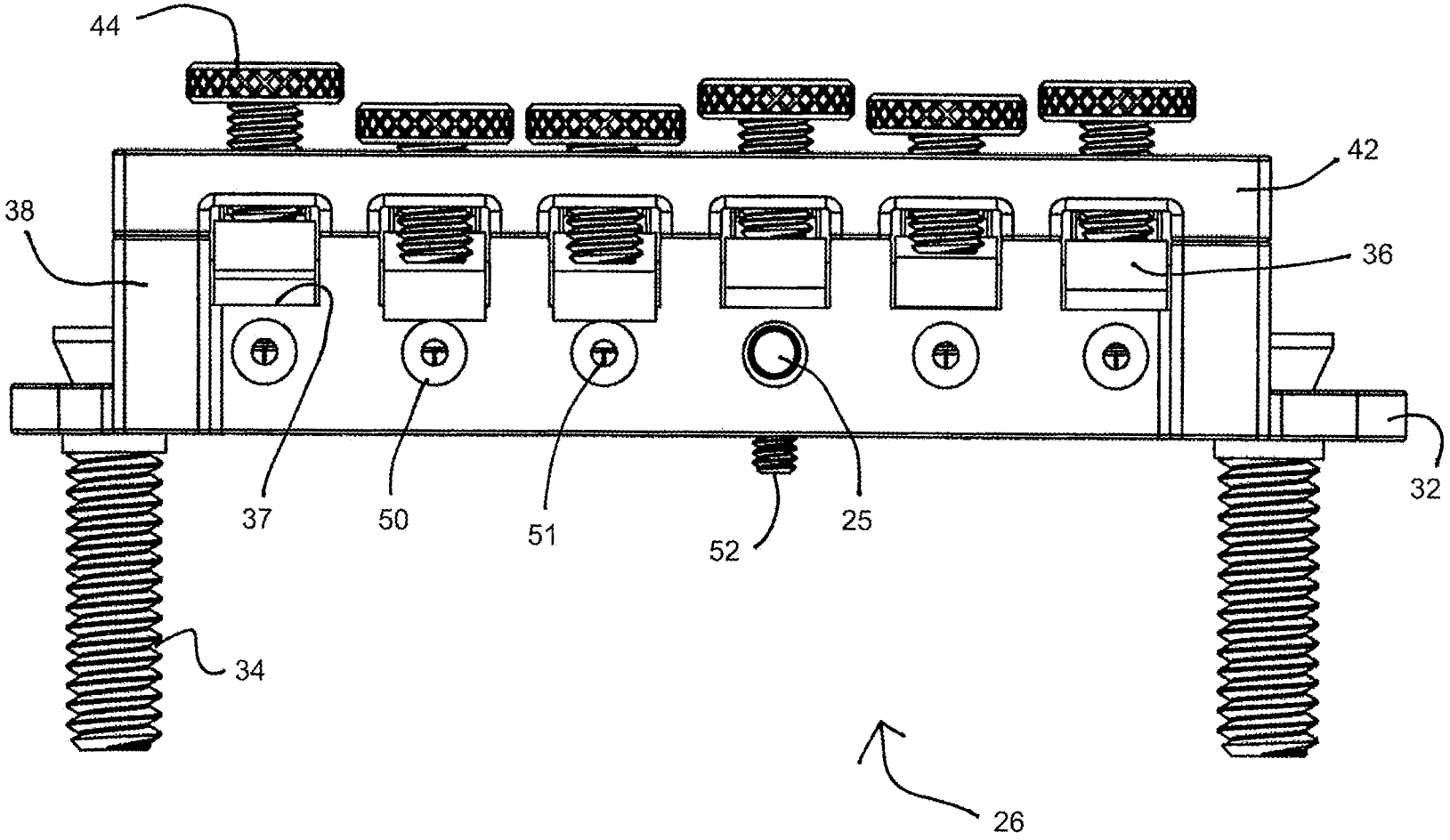
FIG. 4B is a rear plan view illustrating the tremolo and tuning apparatus according to certain embodiments of the disclosure.

FIG. 4B is a rear plan view illustrating the tremolo and tuning apparatus 26 according to certain embodiments of the disclosure. In FIG. 4B, the string ball end 25 of string 24 (G string) is disposed within string nut bore 50. The remainder of string 24 is disposed therethrough string bore 51.

Figure 5:
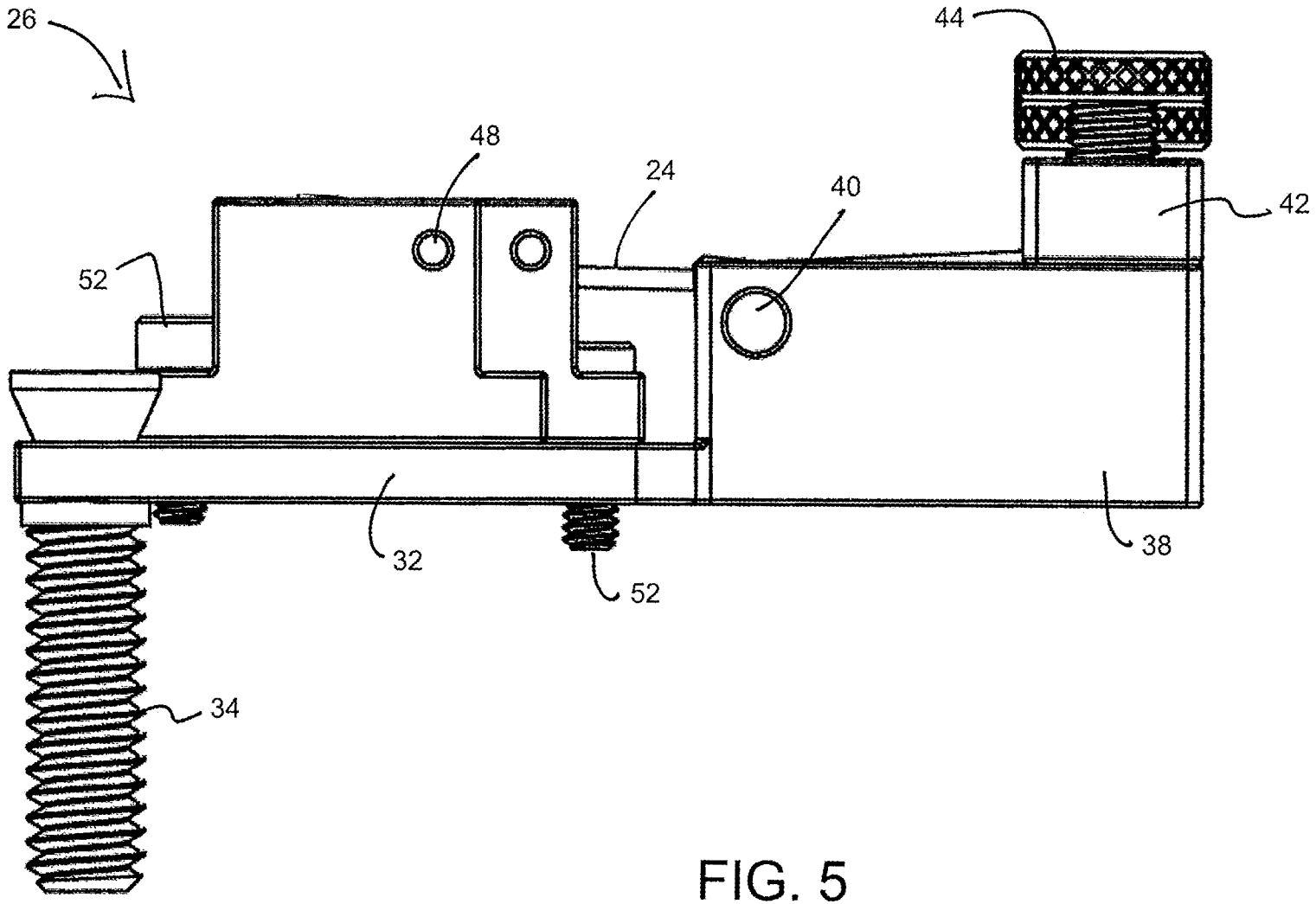
FIG. 5 is a side plan view illustrating the tremolo and tuning apparatus according to certain embodiments of the disclosure.

FIG. 5 is a side plan view illustrating the tremolo and tuning apparatus 26 according to certain embodiments of the disclosure. In FIG. 5, string 24 passes through bridge saddle 30 beneath saddle pin 48 and towards neck 14. Again, head cap screws 52 mount and secure bridge saddle 30 to base tuner plate 32 while tuner plate screws 34 anchor base tuner plate 32 to body 12.

Figure 6:
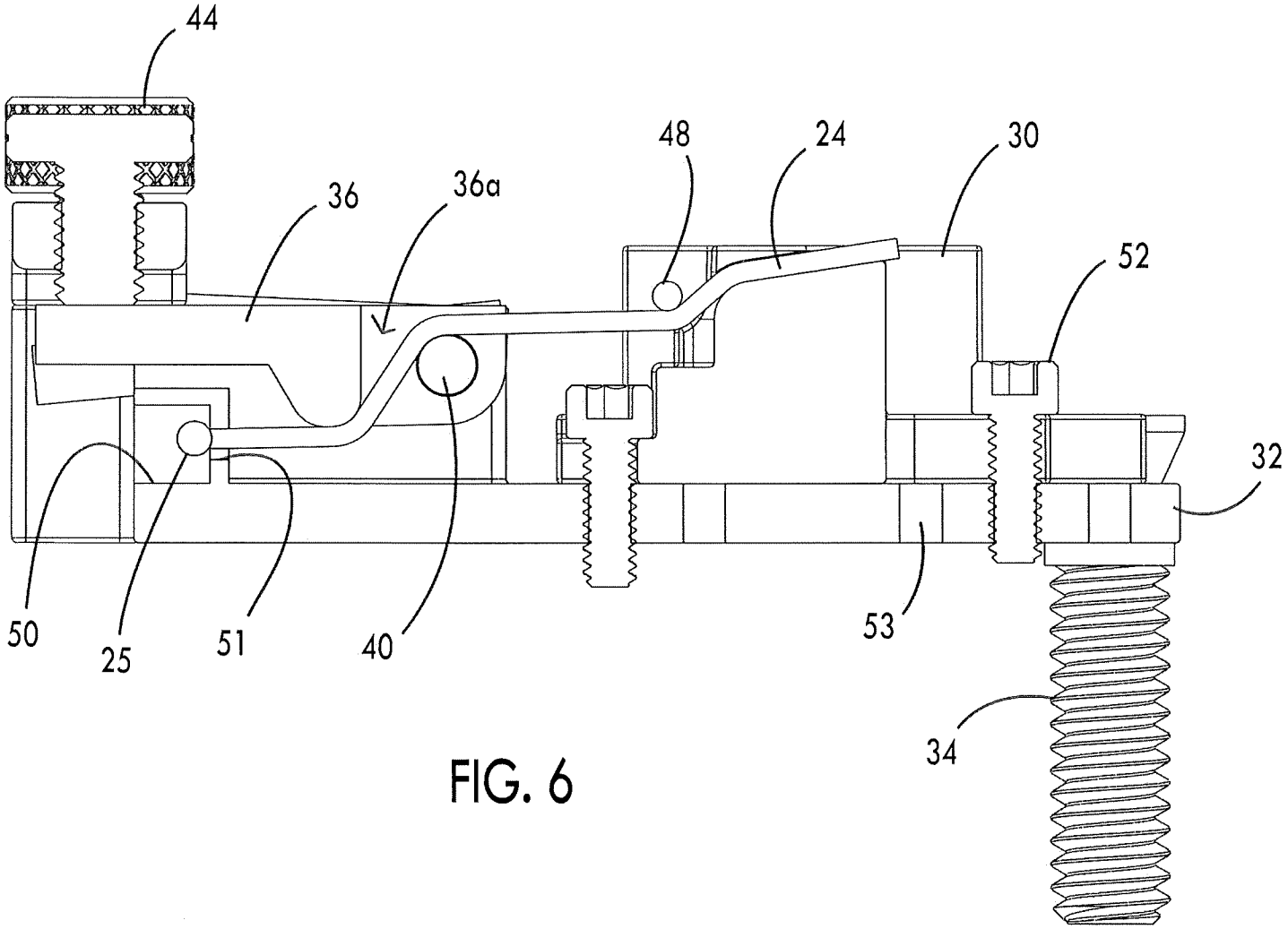
FIG. 6 is a cross-sectional view illustrating the tremolo and tuning apparatus according to certain embodiments of the disclosure.

FIG. 6 is a cross-sectional view illustrating the tremolo and tuning apparatus 26 according to certain embodiments of the disclosure. In FIG. 6, the cross-section illustrates the path of string 24 as discussed above with respect to the string 24 being threaded through string bore 51 while keeping the string ball end 25 attached and resting within string nut bore 50. String 24 may abut a bottom surface of tuner rod 36 and passes above tuner rod plate pin 40 through a gap 36*a* of the tuner rod 36 and beneath a saddle pin 48. Next, string 24 is threaded through bridge saddle 30 to be seated upon string groove 31 and towards neck 14.

FIG. 7A is a perspective view illustrating a base tuner plate 32 and a tuner rod plate 38 of the tremolo and tuning apparatus 26 according to certain embodiments of the disclosure. In FIG. 7A, the base structure is illustrated for the tremolo and tuning apparatus 26. The base structure includes a base tuner plate 32 comprising a plurality of threaded guide holes 53 configured to receive the threaded head cap screws used to secure and hold the saddles 30. The base tuner plate 32 also includes a tremolo bar holder 46 and substantially U-shaped recesses 34*a* configured to accommodate and to receive the tuner plate screws 34. The base structure may also include a tuner rod plate 38 comprising a plurality of tuner rod seats 37, string nut bores 50, string orifices 51 disposed within each string nut bore 50, and tuner rod plate pin bores 41 configured to receive the tuner rod plate pin 40 therethrough. The tuner rod seats 37 are configured to provide open spacing for the tuner rods 36 to move away or towards the tuner rod seats 37 as shown in FIG. 3B, for example when applying or relieving pressure to string 24 when fine tuning.

FIG. 7B is a perspective view illustrating a tuner screw hold down plate 42 of the tremolo and tuning apparatus 26 according to certain embodiments of the disclosure. In FIG. 7B, tuner screw hold down plate 42 comprises threaded screw bores 45 configured to accommodate each fine tuning adjustment screw 44, mounting screw bores 43 configured to accommodate mounting screws to secure the hold down plate 42 to tuner rod plate 38. Further, hold down plate 42 is configured to include a plurality of tuner rod spacers 35 aligned with each tuner rod seat 37 to create an opening for each tuner rod 36 to be disposed therein and to be further aligned with each fine tuning adjustment screw 44 configured to engage or disengage each tuner rod 36.

Figure 8A:
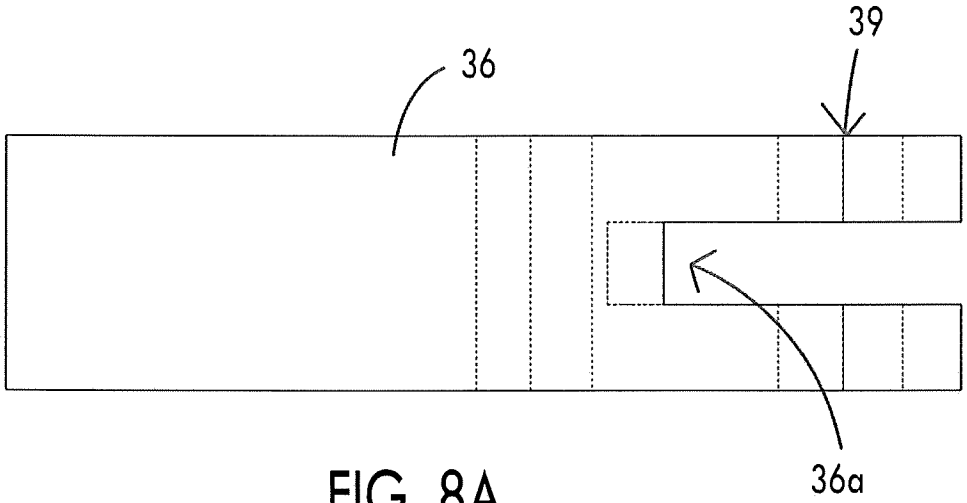
FIG. 8A is a top view illustrating a tuner rod of the tremolo and tuning apparatus according to certain embodiments of the disclosure.
Figure 8B:
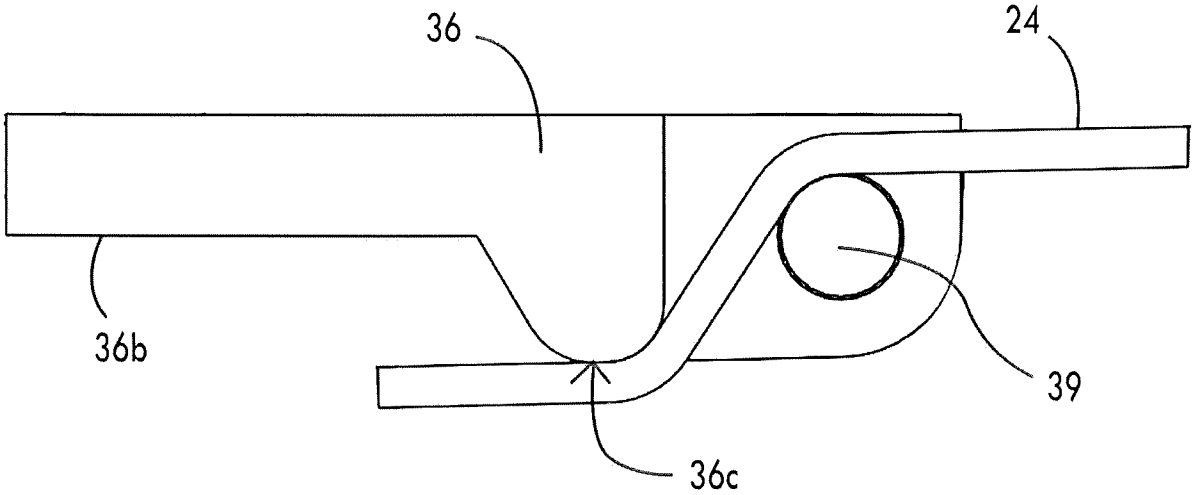
FIG. 8B is a side view illustrating a tuner rod of the tremolo and tuning apparatus according to certain embodiments of the disclosure.

FIGS. 8A and 8B are top and side views, respectively, illustrating a tuner rod 36 of the tremolo and tuning apparatus 26 according to certain embodiments of the disclosure. In FIGS. 8A and 8B, tuner rod 36 is configured to include a gap 36*a*, a lever arm 36*b* and a string abutment surface 36*c* disposed proximal a tuner rod bore 39 or pivot point. Gap 36*a* is configured to receive string 24 threaded above tuner rod plate pin 40 and under saddle pin 48 towards neck 14, as shown in cross-sectional FIG. 3B. In some embodiments, such a threaded configuration provides additional hold and stretching of string 24 while a user depresses tuner rod 36 to adjust pitch of the tremolo and tuning apparatus 26. Tuner rod bore 39 is configured to align with tuner rod plate pin bores 41 when the tremolo and tuning apparatus 26 is assembled.

Figure 9:
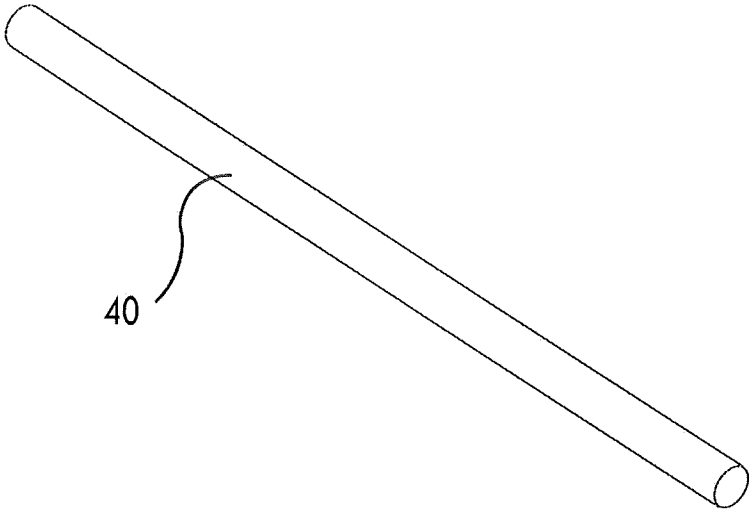
FIG. 9 is a diagrammatic representation illustrating a tuner rod plate pin of the tremolo and tuning apparatus according to certain embodiments of the disclosure.

FIG. 9 is a diagrammatic representation illustrating a tuner rod plate pin 40 of the tremolo and tuning apparatus 26 according to certain embodiments of the disclosure. In FIG. 9, tuner rod plate pin 40 is configured to extend the longitudinal length of the tuner rod plate 38 and to be inserted through the tuner rod bores 39 and tuner rod plate pin bores 41. Tuner rod plate pin 40 securely holds the tuner rods in place to pivot about the tuner rod plate pin 40 when fine tuning string 24 as needed by the user.

Figure 10:
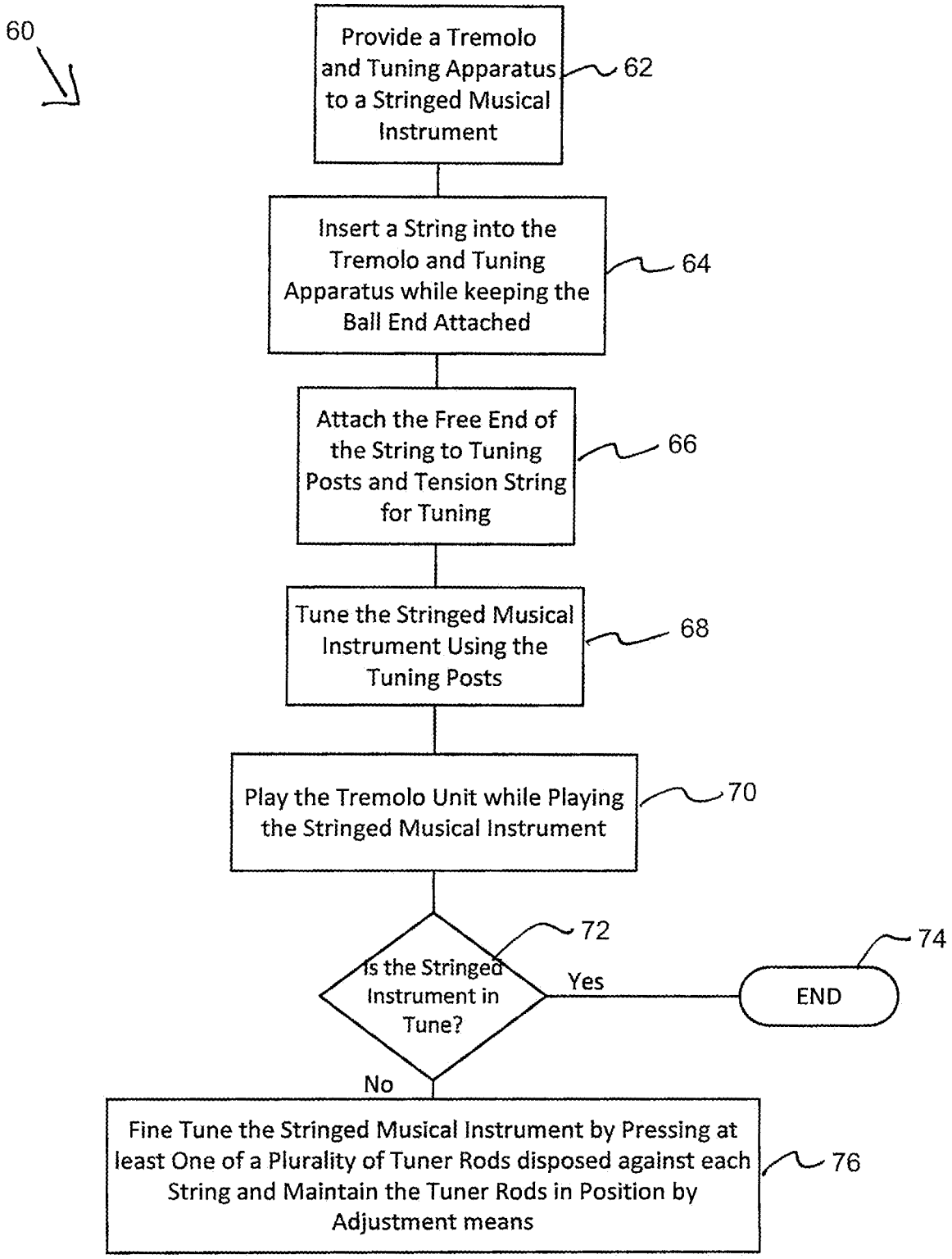
FIG. 10 is a flow chart of the method of fine tuning a tremolo and tuning apparatus via tuner rods according to certain embodiments of the disclosure.

FIG. 10 is a flow chart of the method 60 of fine tuning a tremolo and tuning apparatus 26 via tuner rods 36 according to certain embodiments of the disclosure. In FIG. 10 the method 60 includes providing a tremolo and tuning apparatus to a stringed musical instrument at 62. The method 60 also includes inserting a string into the tremolo and tuning apparatus while keeping the ball end of the string attached at 64. The method 60 further includes attaching the free end of the string to tuning posts of the stringed musical instrument and tensioning the string for tuning at 66. Next, the method 60 includes tuning the stringed musical instrument using the tuning posts at 68. The method 60 also includes playing the tremolo and tuning apparatus while playing the stringed musical instrument at 70. The method 60 further includes determining whether the stringed musical instrument is still in tune after playing the tremolo and tuning apparatus at 72. If the stringed musical instrument remains in tune, then the process ends at 74. If the stringed musical instrument is now out of tune from playing the tremolo and tuning apparatus, then the method 60 includes fine tuning the stringed musical instrument by pressing at least one of the plurality of tuner rods disposed in contact with each string and to maintain the tuner rod pressed position by way of an adjustment means at 76, such as the fine tuning adjustment screws discussed above.

Figure 11:
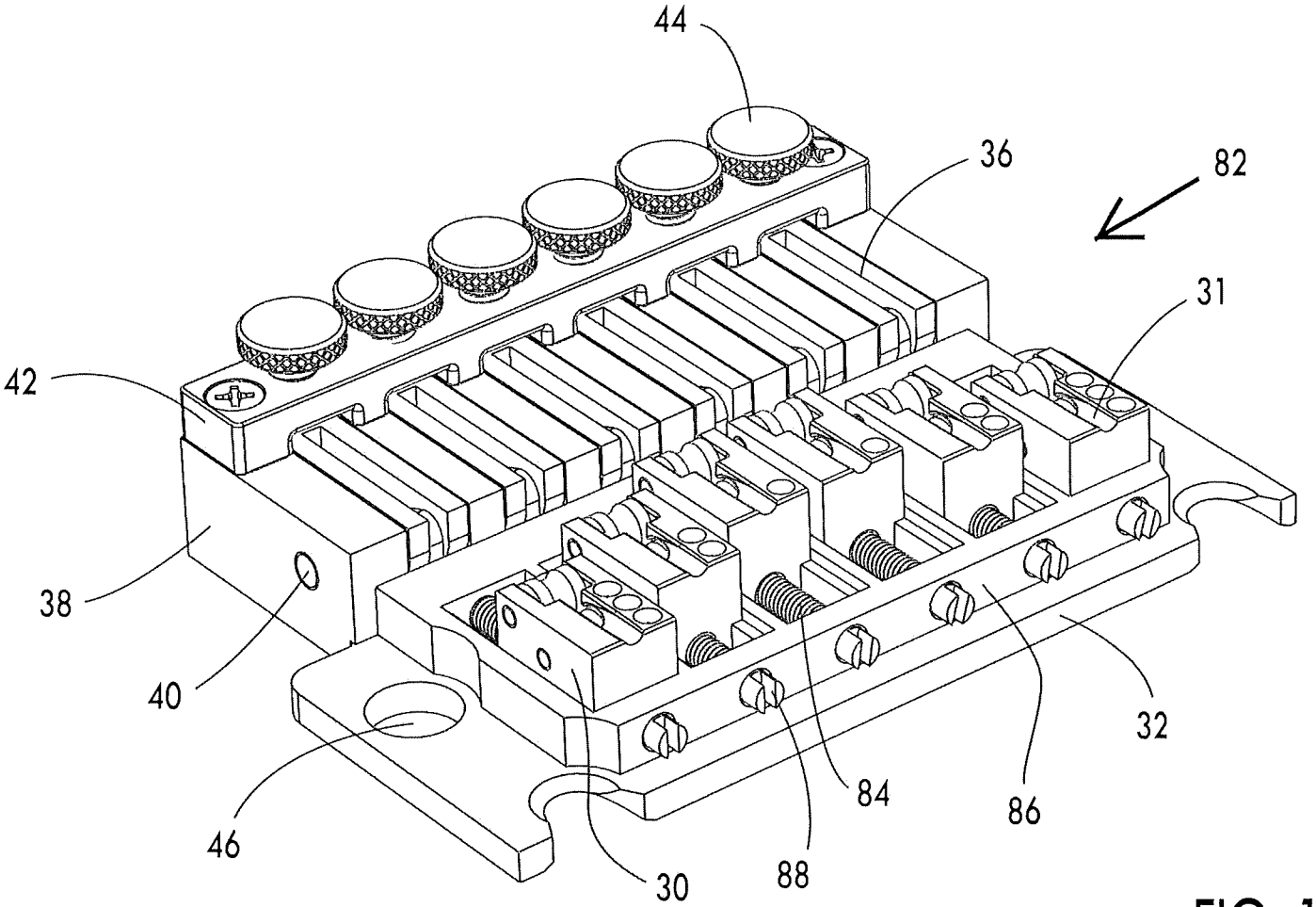
FIG. 11 is a front perspective view illustrating a second embodiment of an exemplary tremolo and tuning apparatus of a type suitable for carrying out the functions of the invention.
Figure 12:
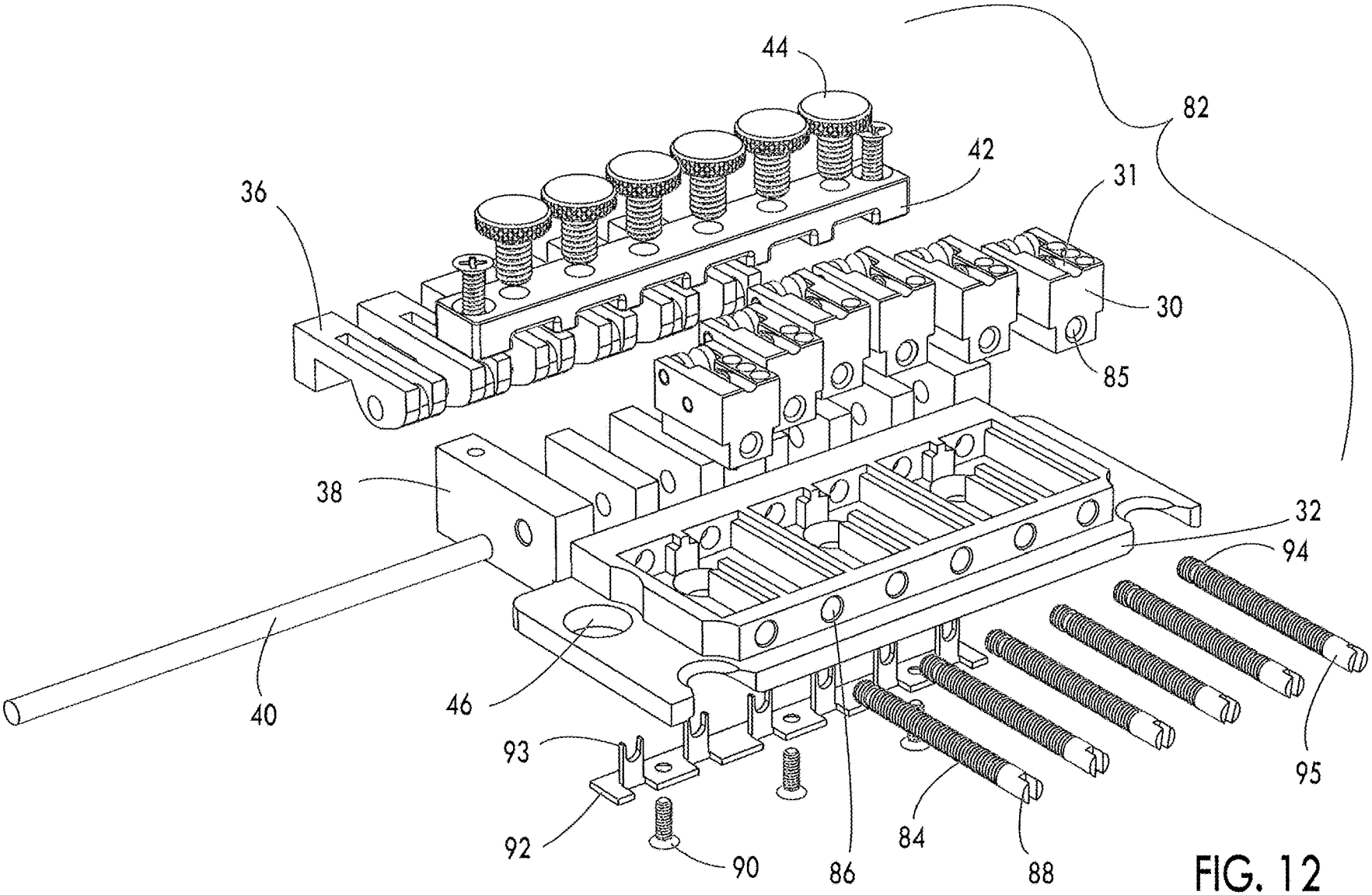
FIG. 12 is a top exploded view of the apparatus of FIG. 11.
Figure 13:
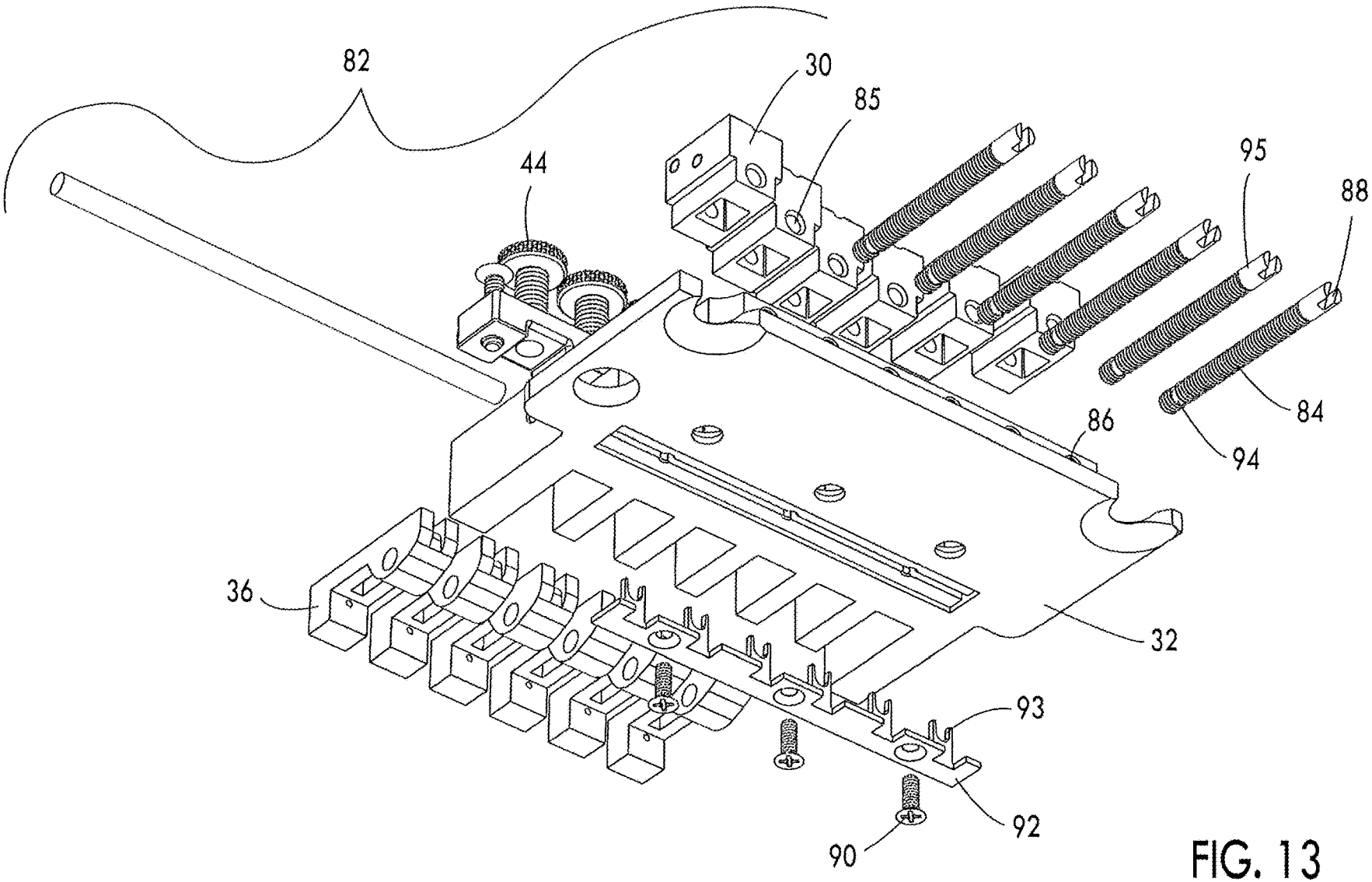
FIG. 13 is a bottom exploded view of the apparatus of FIG. 11.

Insert new figures description here: FIGS. 11 to 13 illustrate a second embodiment of the invention where like parts to the first embodiment are designated with the same numerals. In the second embodiment, the tremolo and tuning apparatus 82 also includes a base tuner plate 32 and a plurality of bridge saddles 30. The base tuner plate 32 is arranged on the body 12 by tuner plate screws. The bridge saddles 30 are arranged on the upper surface of the base tuner plate 32 and supports the strings 24. The bridge saddles 30 are also configured as a one-piece saddle. The tremolo and tuning apparatus 26 includes a plurality of tension applying mechanisms or tuner rods 36 and the tremolo manipulation mechanism or tremolo bar 28 shown in FIG. 1. A similar tension applying mechanism urges the base tuner plate to flex or rotate to apply tension to the strings 24. The tremolo bar 28 is located on the base tuner plate 32 and flexes or rotates the base tuner plate 32 about the tuner plate screws (shown as 34 in FIG. 2). This operates in essentially the same way as the first embodiment.

The number of the bridge saddles 30 corresponds to the number of the strings 24. The bridge saddles 30 are identical, and the structure of one of the bridge saddles 30 will now be described. These saddles are similar to those described with reference to FIGS. 2 to 6 but have the following differences. Each bridge saddle 30 includes a string holder groove 31 but as shown in FIGS. 11-13, instead of having a front slot 33 at its distal end that is held in position by bolt 52, each bridge saddle includes a longitudinal threaded opening that receives a rotatable pin 84 that passes through an unthreaded aperture in the front wall of frame 86, then through the threaded opening in the bridge saddle 30. Thus, rotation of the pin, such as with the use of a screwdriver that is placed in a slot in rotatable pin head 88 moves bridge member 30 linearly back or forth to a desired position. This arrangement allows much easier adjustment of the position of the bridge member compared to that of the first embodiment, where bolt 52 must first be released to allow saddle 30 to be repositioned before re-tightening bolt 52 to secure the saddle in the desired position.

Also, bolts 90 are used to attach support plate 92 to the base tuner plate. Support plate 92 includes U-shaped supports 93 that support the rearward portions 94 of pins 84. As shown in FIGS. 12-13, pin 44 also has an unthreaded portion 95 in the forward end to facilitate rotation in opening 86 when rotated to position bridge block 30 as desired.

Figure 14:
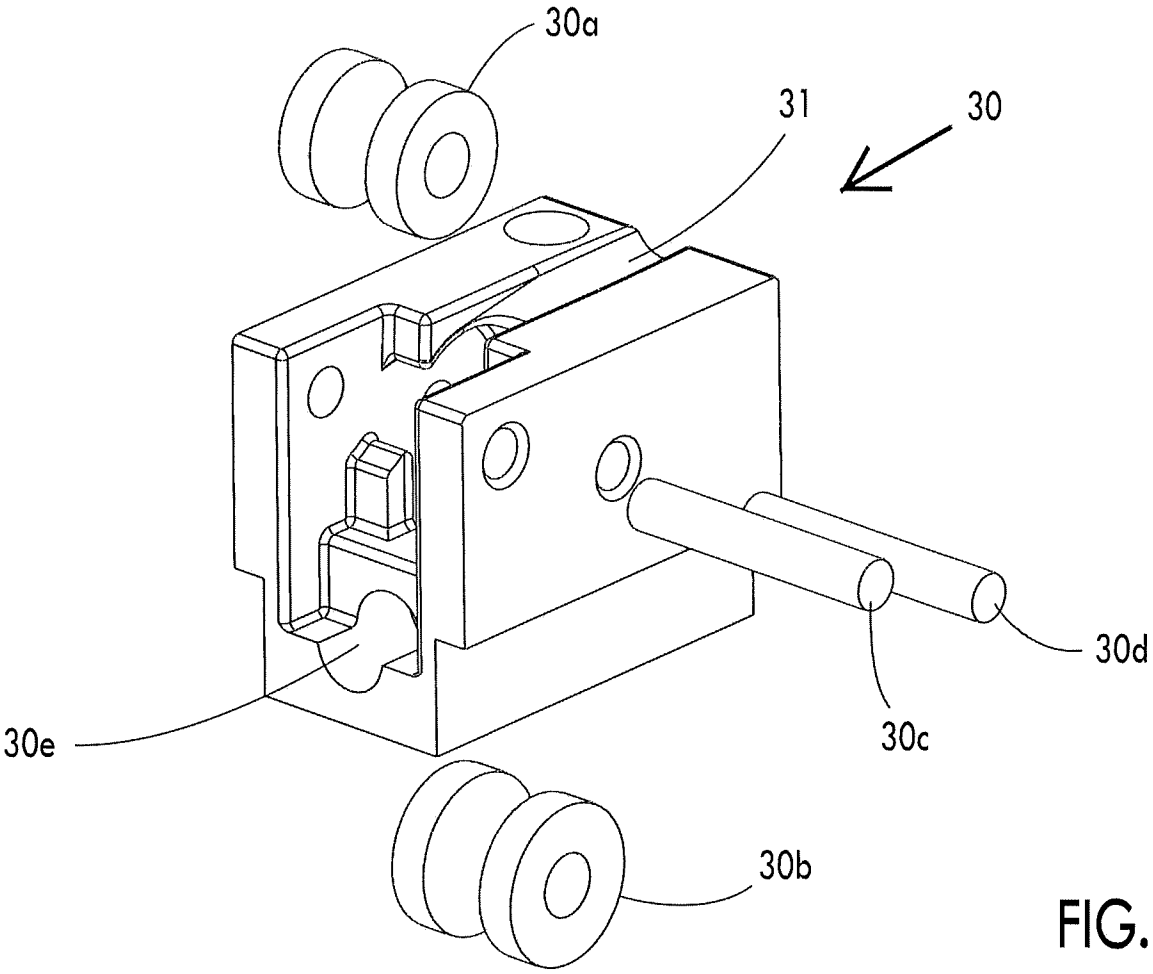
FIG. 14 is an exploded view of a bridge saddle for use with the second embodiment of the invention.

FIG. 14 illustrates the bridge saddle 30 for use in the second embodiment. This saddle 30 has two rollers 30*a*, 30*b* that support the guitar string as it passes over the rollers and through the channel 31. Rollers 30*a*, 30*b* are mounted in the saddle by axles 30*c*, 30*d*, respectively. Whereas a single roller can be used for the bridge saddle of the first embodiment, the sue of a second roller assists in more smoothly directing the string into the channel 31. FIG. 14 also illustrates the exit of the bore 30*e* through which the rotatable pin 84 passes. As noted herein, the bore is threaded so that rotation of the pin causes liner movement of the saddle.

FIGS. 2 and 11 illustrate another feature of the invention relating to the height of the bridge saddles. As shown the two bridge saddles in the center have one or more circles on the top portion to indicate the height of the saddle. The heights differ by a few thousandths so that the outer saddles are slightly shorter than the inner saddles. This corresponds to the height of the strings on the guitar. The two saddles in the center have one circle to indicate that they have the greatest height, with the next adjacent saddles having two circles to indicate that they are slightly shorter than the enter saddles, and the two outermost saddles have three circles to indicate that they are even shorter than the adjacent saddles. These designations enable the saddles to be installed correctly as the visual indication of height is easier to see than trying to visually determine the height of each one.

Although an example of the tremolo and tuning apparatus 26 is shown using an electric guitar as the stringed musical instrument 10, it will be appreciated that other stringed musical instruments can be used.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A tremolo and tuning apparatus for a stringed musical instrument, comprising:

a base tuner plate attached to the stringed musical instrument;

a plurality of saddles adjustably attached to the base tuner plate and configured to hold unmodified strings;

a plurality of tuner rods corresponding to and aligned with strings disposed on the stringed musical instrument;

a tuner screw hold down plate disposed above the plurality of tuner rods;

a plurality of fine tuning adjustment screws disposed proximal the plurality of tuner rods; and wherein each of the plurality of tuner rods is configured to provide pressing contact via a user to each of their corresponding strings to fine tune each corresponding string, and wherein each of the plurality of fine tuning adjustment screws is configured to provide a stop abutment at a top surface of each of the corresponding plurality of tuner rods.

2. The apparatus of claim 1, wherein the tuner rod plate comprises a plurality of string nut bores configured to securely hold a string nut of a string of the stringed musical instrument.

3. The apparatus of claim 2, further comprising a plurality of string bores disposed within the plurality of string nut bores, where each of the plurality of string bores is configured to receive each string.

4. The apparatus of claim 1, wherein the plurality of tuner rods are disposed separate and apart from the plurality of saddles.

5. The apparatus of claim 1, wherein each of the plurality of saddles is configured as a one-piece saddle.

6. The apparatus of claim 1, wherein the plurality of tuner rods are configured to pivot about a common axis.

7. The apparatus of claim 1, wherein the tuner plate comprises a tremolo bar holder.

8. The apparatus of claim 7, wherein the tremolo bar holder is configured to provide a press fit to a tremolo bar disposed therein.

9. The apparatus of claim 1, wherein the base tuner plate is attached to the stringed musical instrument by an arrangement of plate screws located at the distal end of the turner plate.

10. The apparatus of claim 9, wherein the tuner plate screws are disposed within U-shaped openings at the distal end of the tuner plate.

11. The apparatus of claim 1, wherein the common axis comprises a tuner rod plate pin configured to extend the length of the tuner rod plate.

12. The apparatus of claim 1, wherein the tuner rod plate is configured to receive the plurality of tuner rods within a plurality of tuner rod seats disposed on an upper portion of the tuner rod plate.

13. The apparatus of claim 1, further comprising a tuner rod plate integral with the base tuner plate and configured to provide a plurality of tuner rod seats, wherein the tuner screw hold down plate is attached to the tuner rod plate.

14. The apparatus of claim 1, wherein the saddles are removably attached to the base tuner plate so that they can be selectively positioned.

15. The apparatus of claim 1, wherein the saddles are operatively associated with the base tuner plate by rotatable pins such that rotation of the pins adjusts the position of the saddles on the base tuner plate.

16. The apparatus of claim 1, wherein six bridge saddles are present to support six guitar strings, wherein each saddle has two rollers and a channel for supporting one guitar string, wherein the first and sixth saddle have the same height, the second and fifth saddle have the same height which is greater than that of the first and sixth saddles and the third and fourth saddles have the same height which is greater than that of the second and fifth saddles.

* * * * *